US010931051B2

(12) United States Patent
Wang et al.

(10) Patent No.: US 10,931,051 B2
(45) Date of Patent: Feb. 23, 2021

(54) CONNECTOR AND RECEPTACLE

(71) Applicant: Tyco Electronics (Shanghai) Co. Ltd., Shanghai (CN)

(72) Inventors: Yunhe Wang, Shanghai (CN); Zhigang Song, Shanghai (CN); Jiahui Chen, Shanghai (CN); Lin Ni, Shanghai (CN); Songhua Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/353,454

(22) Filed: Mar. 14, 2019

(65) Prior Publication Data

US 2019/0288433 A1 Sep. 19, 2019

(30) Foreign Application Priority Data

Mar. 15, 2018 (CN) ..... 201810214081.3

(51) Int. Cl.

| | |
|---|---|
| ***H01R 13/24*** | (2006.01) |
| ***H01R 24/54*** | (2011.01) |
| ***H01R 13/631*** | (2006.01) |
| ***H01R 13/11*** | (2006.01) |
| *H01R 103/00* | (2006.01) |

(52) U.S. Cl.

CPC ..... *H01R 13/2457* (2013.01); *H01R 13/111* (2013.01); *H01R 13/2478* (2013.01); *H01R 13/631* (2013.01); *H01R 24/542* (2013.01); *H01R 2103/00* (2013.01)

(58) Field of Classification Search

CPC .. H01R 24/40; H01R 9/0518; H01R 13/6315; H01R 13/646; H01R 13/6473; H01R 12/716; H01R 13/187; H01R 24/58

USPC ..... 439/578

See application file for complete search history.

(56) References Cited

U.S. PATENT DOCUMENTS

| | | | | |
|---|---|---|---|---|
| 4,326,769 A * | 4/1982 | Dorsey | H01R 24/40 | 439/21 |
| 4,426,127 A * | 1/1984 | Kubota | H01R 24/40 | 439/607.17 |
| 4,655,534 A * | 4/1987 | Stursa | H01R 13/646 | 439/582 |
| 5,037,328 A * | 8/1991 | Karlovich | H01R 9/0518 | 439/578 |
| 5,094,623 A * | 3/1992 | Scharf | H01R 13/6473 | 439/101 |

(Continued)

*Primary Examiner* — Jean F Duverne
(74) *Attorney, Agent, or Firm* — Barley Snyder

(57) ABSTRACT

A connector comprises an adapter and a first receptacle adapted to be assembled onto a first end of the adapter. The adapter includes an outer contact, an inner contact, and an insulator between the outer contact and the inner contact. The first receptacle includes a first outer terminal in electrical contact with a first end of the outer contact, a first inner terminal in electrical contact with a first end of the inner contact, and a first insulative body between the first outer terminal and the first inner terminal. The first outer terminal includes a plurality of first elastic contact structures. Each of the first elastic contact structures has an elastic arm and a first contact point formed on the elastic arm. The first contact point is adapted to elastically electrically contact an inner wall of the first end of the outer contact.

20 Claims, 10 Drawing Sheets

(56) References Cited

U.S. PATENT DOCUMENTS

| | | | | | |
|---|---|---|---|---|---|
| 5,147,221 | A * | 9/1992 | Cull | H01R 24/40 | 439/585 |
| 5,516,303 | A * | 5/1996 | Yohn | H01R 13/6315 | 439/248 |
| 5,807,116 | A * | 9/1998 | Kitatani | H01R 24/58 | 439/63 |
| 7,841,906 | B2 * | 11/2010 | Dent | H01R 13/187 | 439/489 |
| 9,147,963 | B2 * | 9/2015 | Balcer | H01R 9/0524 | |
| 10,340,644 | B1 * | 7/2019 | Lee | H01R 12/716 | |

* cited by examiner

CONNECTOR AND RECEPTACLE

CROSS-REFERENCE TO RELATED APPLICATION

This application claims the benefit of the filing date under 35 U.S.C. § 119(a)-(d) of Chinese Patent Application No. 201810214081.3, filed on Mar. 15, 2018.

FIELD OF THE INVENTION

The present invention relates to an electrical connector and, more particularly, to a radio frequency electrical connector adapted to connect two circuit boards.

BACKGROUND

A radio frequency (RF) coaxial connector of a BTB type, connecting a printed circuit board to another printed circuit board, generally includes two receptacles and an adapter. Each receptacle typically includes a cylindrical outer terminal, a cylindrical inner terminal, an insulative body, and an insulative housing. The inner terminal is disposed in the outer terminal, and the insulative body is disposed between the inner terminal and the outer terminal for supporting the inner terminal and isolating the inner terminal from the outer terminal. The outer terminal is received and positioned in the insulative housing. The adapter generally includes a cylindrical outer contact, a cylindrical inner contact, and an insulator. The inner contact is disposed in the outer contact, and the insulator is disposed between the inner contact and the outer contact for supporting the inner contact and isolating the inner contact from the outer contact.

The outer terminal of the receptacle is generally cylindrical, with a relatively high rigidity. The outer terminal of the receptacle is difficult to insert into the outer contact of the adapter, increasing an assembly difficulty, resulting in an unreliable electrical contact, and deteriorating a performance of the RF coaxial connector. Further, the outer terminal of the receptacle is only produced by a machining processes, resulting in a high cost.

SUMMARY

A connector comprises an adapter and a first receptacle adapted to be assembled onto a first end of the adapter. The adapter includes an outer contact, an inner contact, and an insulator between the outer contact and the inner contact. The first receptacle includes a first outer terminal in electrical contact with a first end of the outer contact, a first inner terminal in electrical contact with a first end of the inner contact, and a first insulative body between the first outer terminal and the first inner terminal. The first outer terminal includes a plurality of first elastic contact structures. Each of the first elastic contact structures has an elastic arm and a first contact point formed on the elastic arm. The first contact point is adapted to elastically electrically contact an inner wall of the first end of the outer contact.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
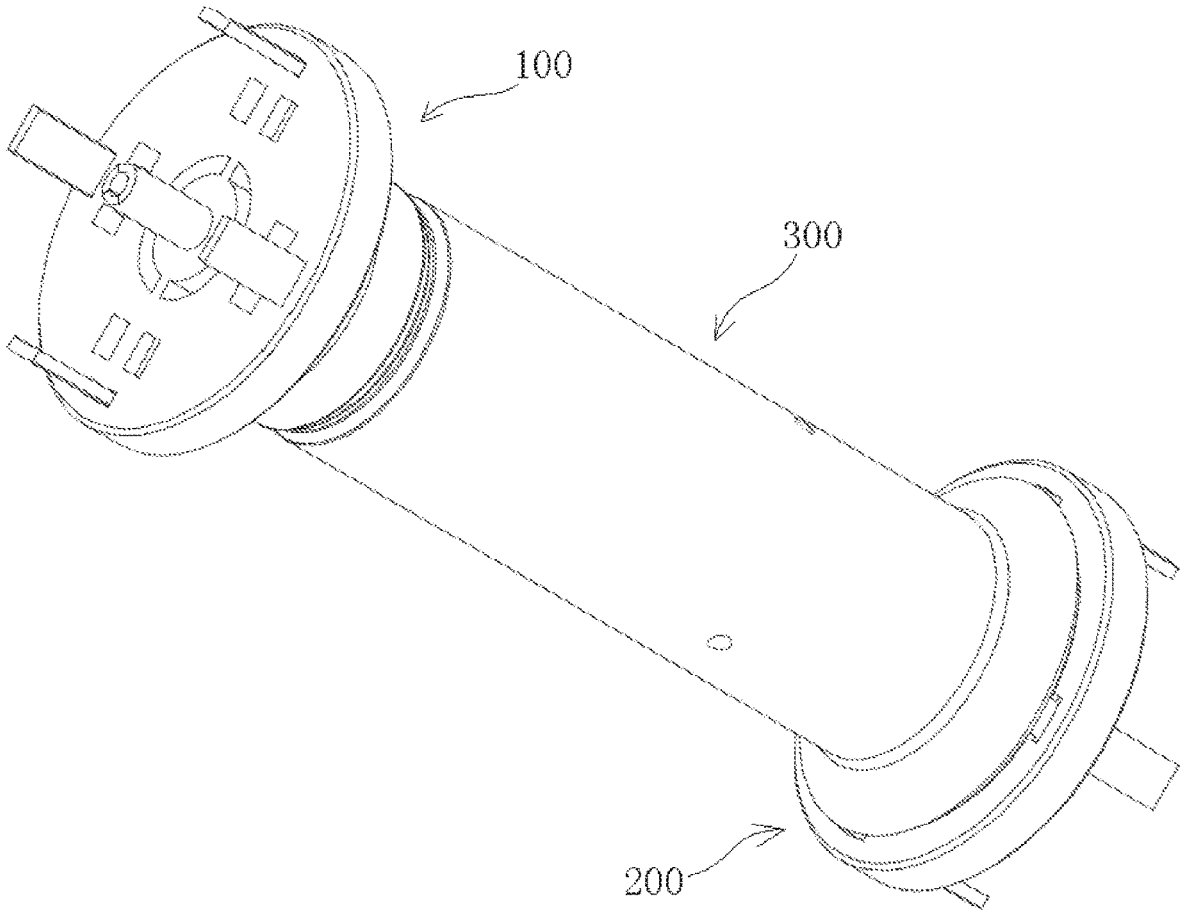
FIG. 1 is a perspective view of a connector according to an embodiment.

The present invention will be further specifically described below by reference to embodiments of the present disclosure, taken in conjunction with the accompanying drawings. In the specification, the same or similar reference numerals indicate the same or similar elements. The description of the embodiments of the present disclosure with reference to the accompanying drawings is intended to illustrate the general inventive concept of the present disclosure, and should not be construed as limiting the invention.

Moreover, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
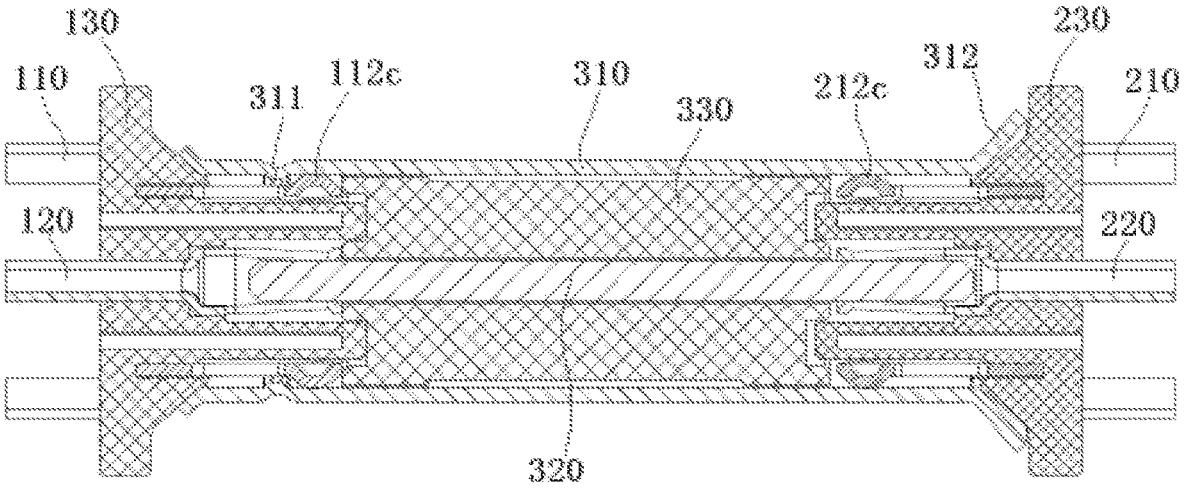
FIG. 2 is a sectional side view of the connector.

A connector according to an embodiment, as shown in FIGS. 1 and 2, includes an adapter 300, a first receptacle 100, and a second receptacle 200. The first receptacle 100 is adapted to be assembled onto a first end of the adapter 300 and the second receptacle 200 is adapted to be assembled onto a second end of the adapter 300 opposite the first end of the adapter 300. In an embodiment, the connector may be a radio frequency coaxial connector adapted to be connected between two circuit boards.

In the shown embodiment, the first receptacle 100 has a same structure as the second receptacle 200. In other embodiments, however, the first receptacle 100 may be different from the second receptacle 200 in structure.

As shown in FIGS. 7-10, in the shown embodiment, the adapter 300 includes a cylindrical outer contact 310, a cylindrical inner contact 320, and an insulator 330 between the outer contact 310 and the inner contact 320. The insulator 330 is configured to support both the outer contact 310 and the inner contact 320 and electrically isolate the outer contact 310 from the inner contact 320.

As shown in FIGS. 1-6, in the shown embodiment, the first receptacle 100 includes a first outer terminal 110 in electrical contact with a first end of the outer contact 310, a first inner terminal 120 in electrical contact with a first end of the inner contact 320, and a first insulative body 130 between the first outer terminal 110 and the first inner terminal 120. The first insulative body 130 is configured to support both the first outer terminal 110 and the first inner terminal 120 and electrically isolate the first outer terminal 110 from the first inner terminal 120.

Figure 3:
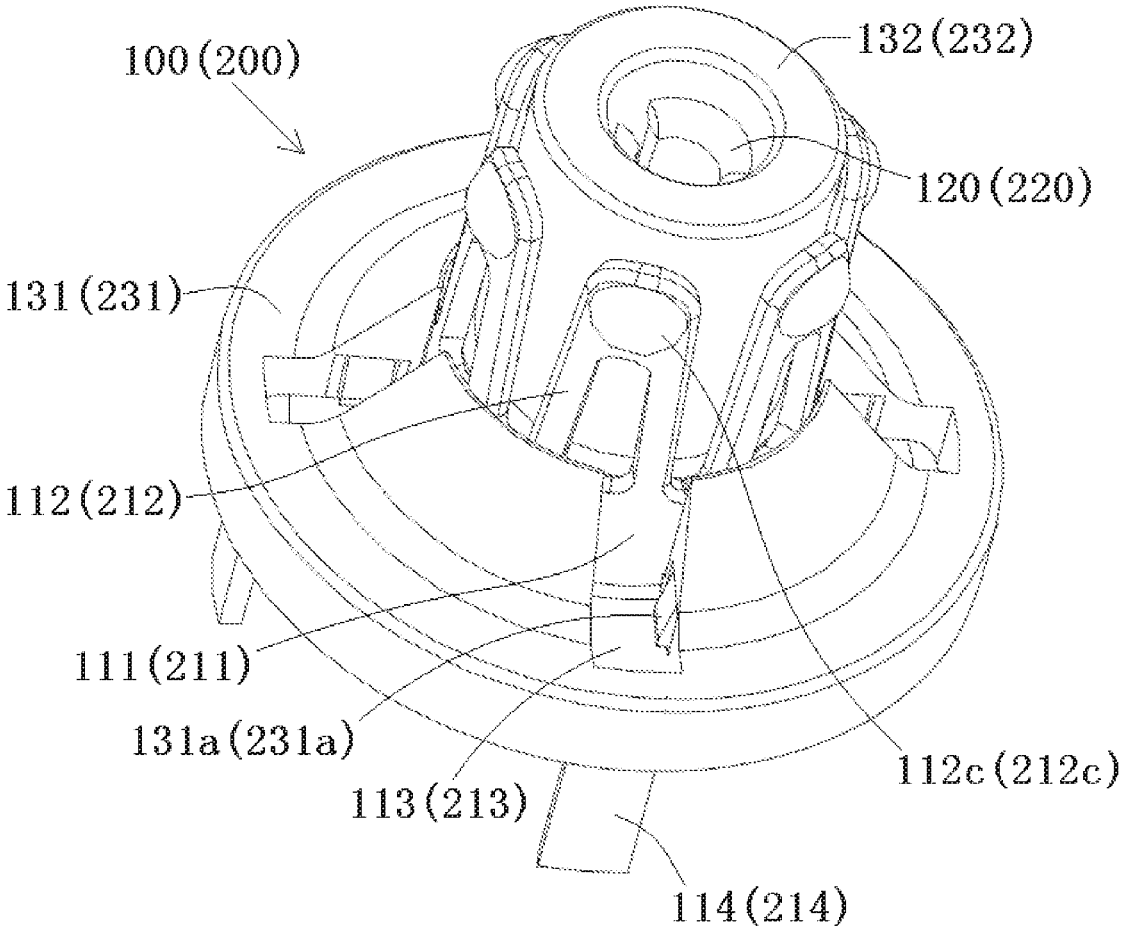
FIG. 3 is a perspective view of a receptacle of the connector.
Figure 5:
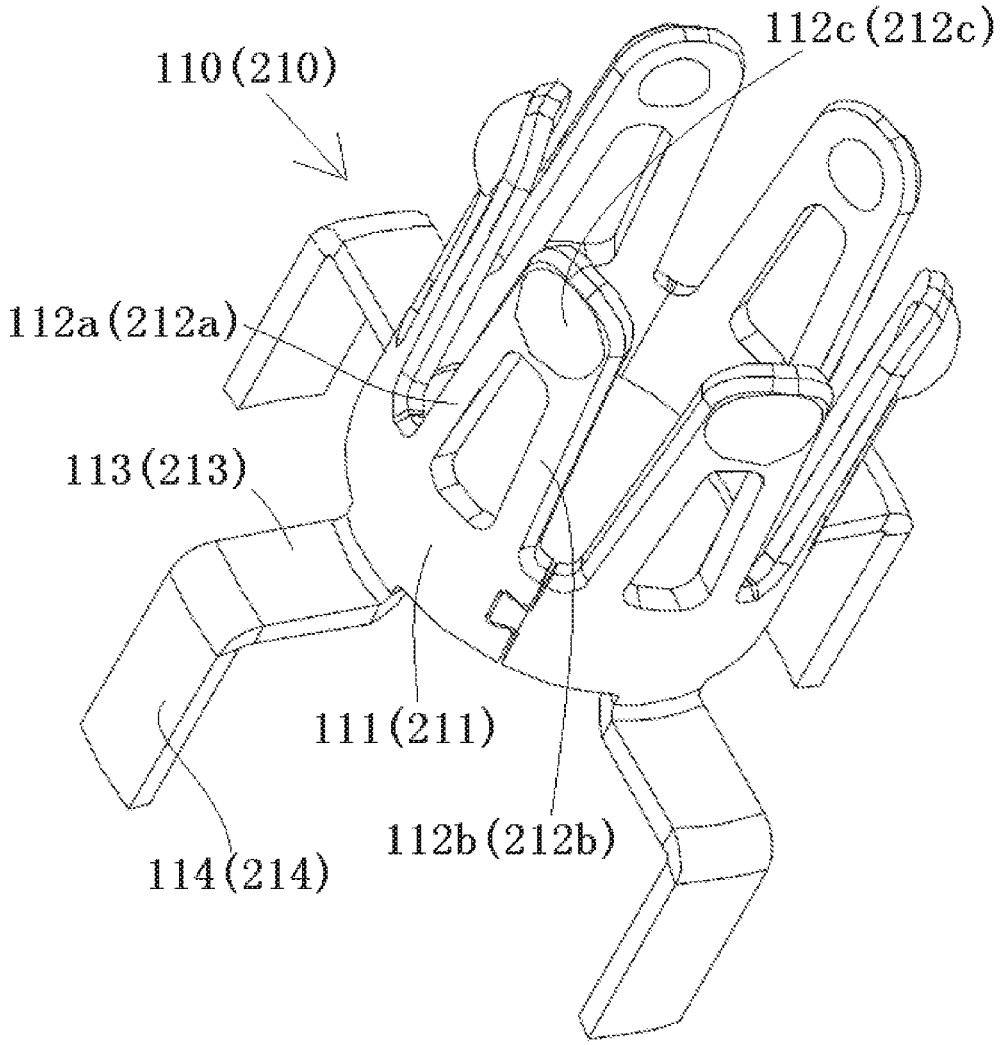
FIG. 5 is a perspective view of an outer terminal of the receptacle.

As shown in FIGS. 2, 3 and 5, the first outer terminal 110 includes a plurality of first elastic contact structures 112. Each of the first elastic contact structures 112 includes a first contact point 112*c* and a pair of first elastic arms 112*a*, 112*b* which intersect at the first contact point 112*c* such that each of the first elastic contact structures 112 is formed in a triangular shape. The first contact point 112*c* is adapted to elastically electrically contact with an inner wall of the first end of the outer contact 310. In an embodiment, the outer terminal 110 is formed by a stamping process.

Figure 6:
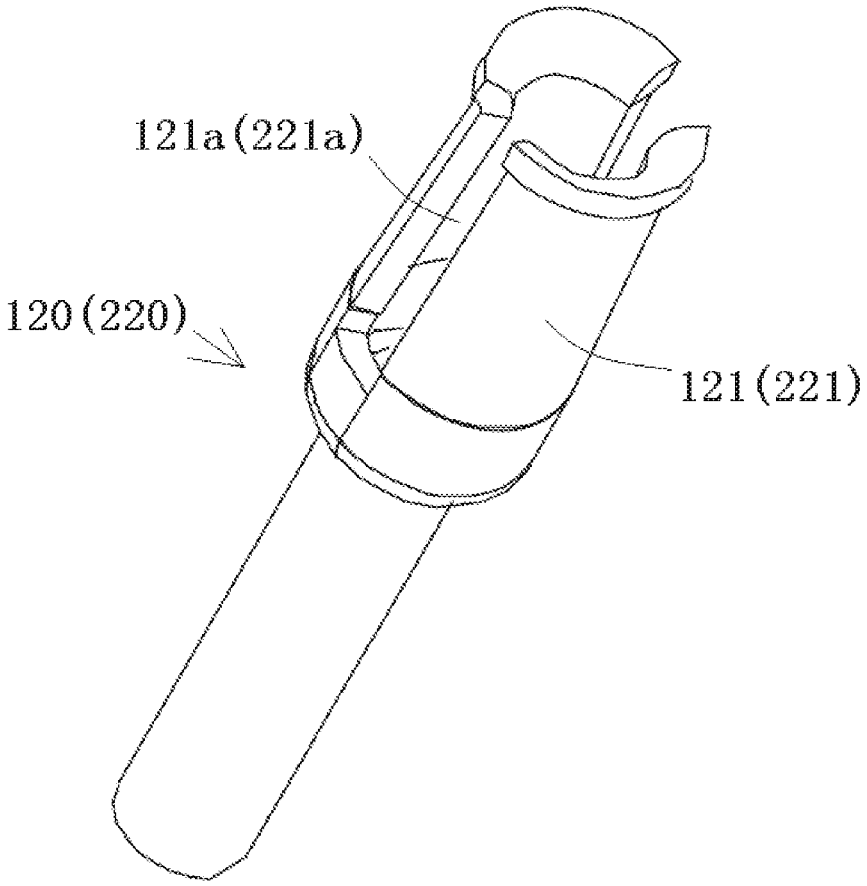
FIG. 6 is a perspective view of an inner terminal of the receptacle.
Figure 7:
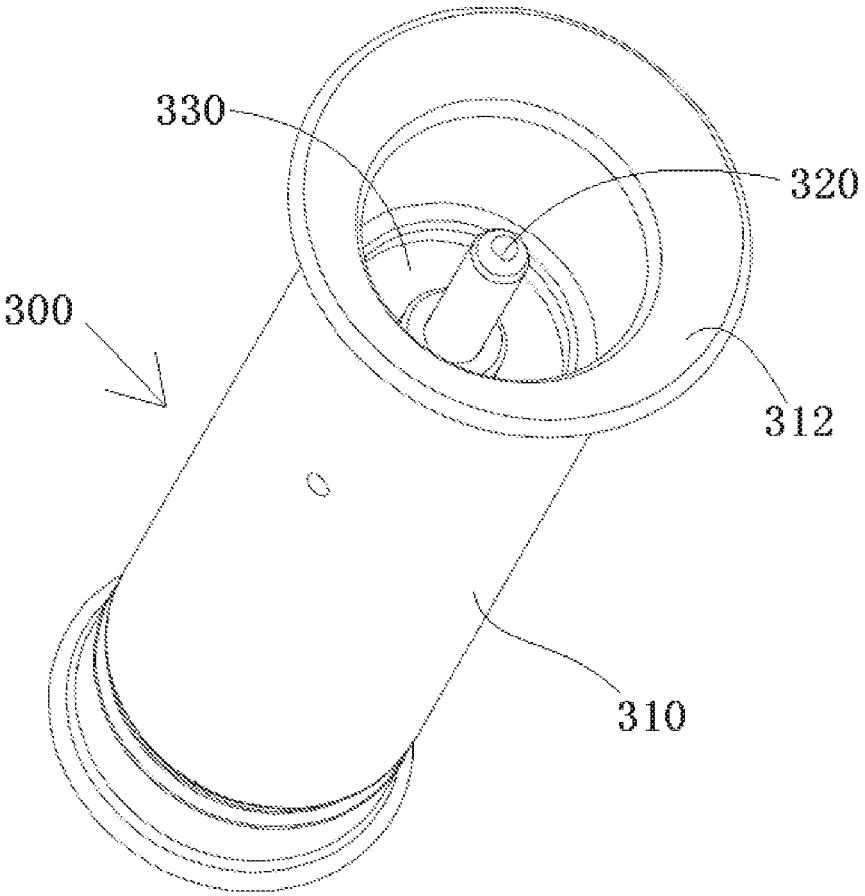
FIG. 7 is a perspective view of an adapter of the connector.
Figure 8:
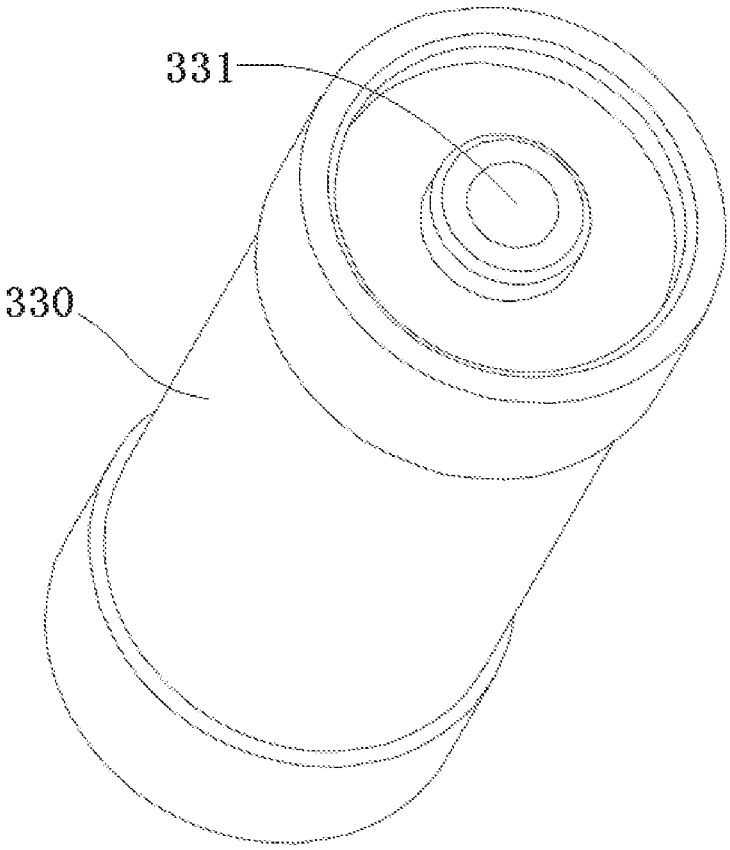
FIG. 8 is a perspective view of an insulator of the adapter.
Figure 9:
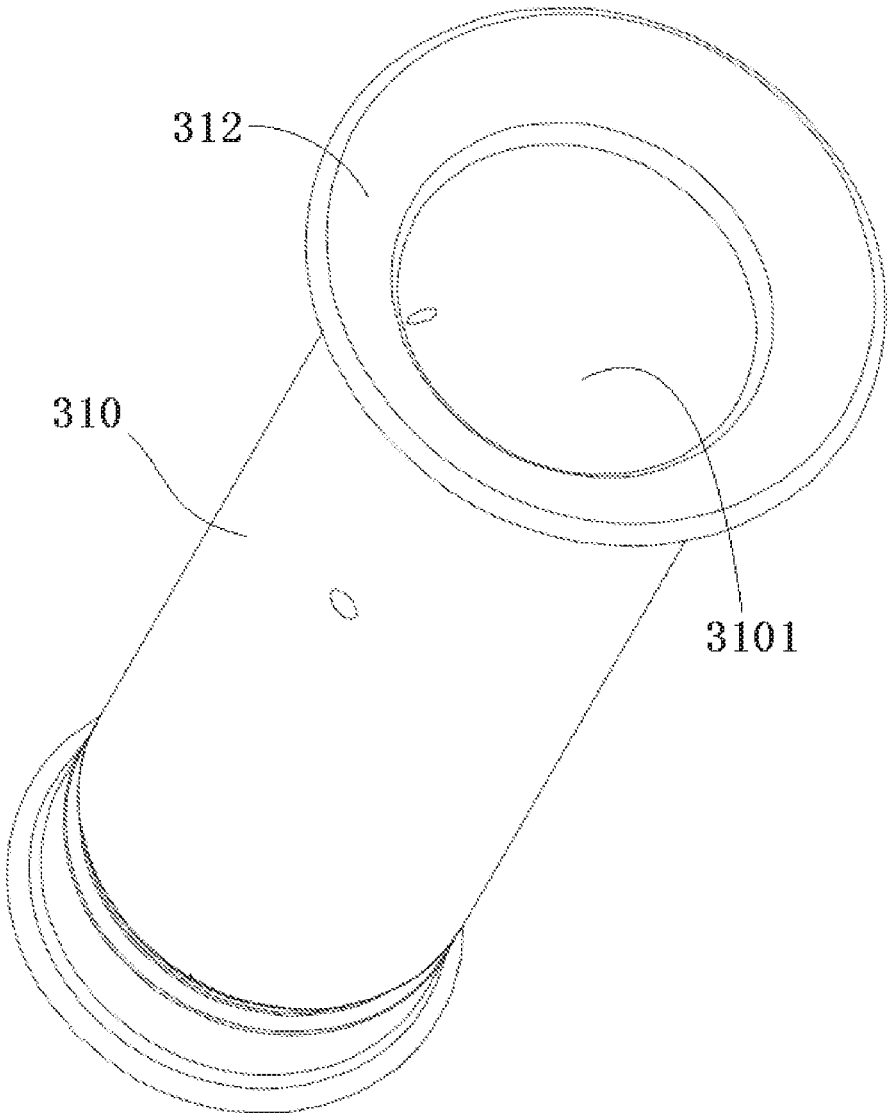
FIG. 9 is a perspective view of an outer contact of the adapter.
Figure 10:
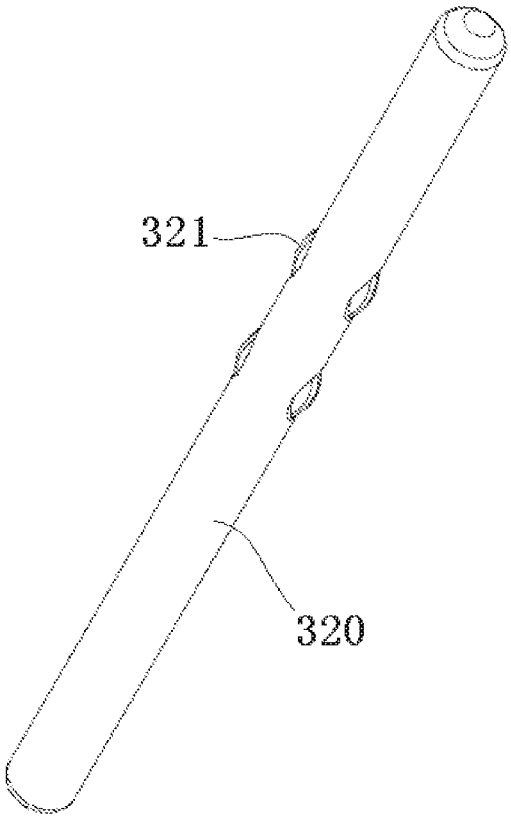
FIG. 10 is a perspective view of an inner contact of the adapter.

As shown in FIGS. 2 and 6, the first inner terminal 120 includes a cylindrical first plug end 121. The first end of the inner contact 320 is adapted to be plugged into the first plug end 121 of the first inner terminal 120 such that it is in electrical contact with the first plug end 121 of the first inner terminal 120. At least one first axial slot 121*a* is disposed on the first plug end 121 of the first inner terminal 120. The first plug end 121 of the first inner terminal 120 is an elastic claw having a multi-valve structure to elastically hold the first end of the inner contact 320 plugged therein.

As shown in FIGS. 2, 3 and 5, the first outer terminal 110 includes a first cylindrical base portion 111. The plurality of first elastic contact structures 112 are each connected to a first side of the first cylindrical base portion 111 and are distributed at equal intervals in a circumferential direction of the first cylindrical base portion 111. The first outer terminal 110 includes a plurality of first soldering pins 113, 114 which are connected to a second side of the first cylindrical base portion 111 opposite the first side and distributed at equal intervals in the circumferential direction of the first cylindrical base portion 111.

Figure 4:
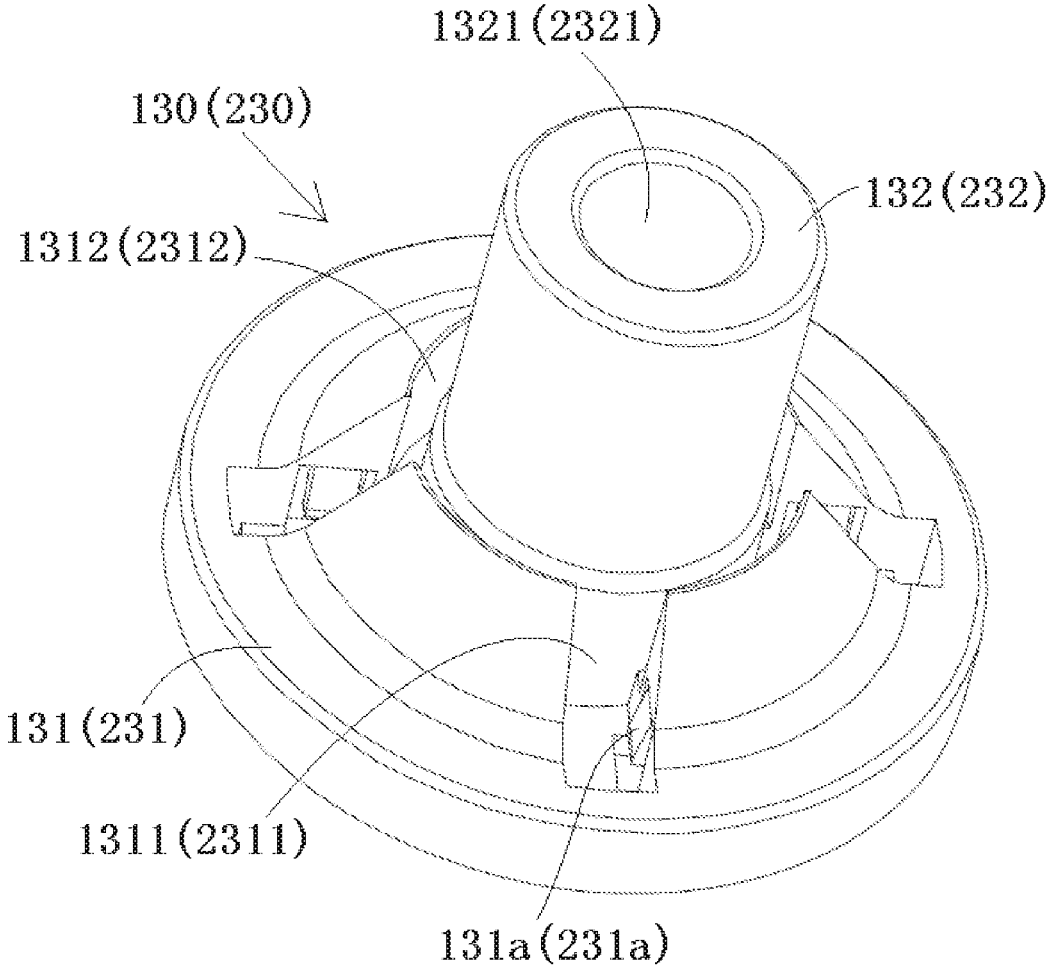
FIG. 4 is a perspective view of an insulative body of the receptacle.

As shown in FIGS. 3 and 4, the first insulative body 130 includes a first base 131 on which a first mounting groove is formed. The first outer terminal 110 is adapted to be mounted and fixed in the first mounting groove. Each of the first soldering pins 113, 114, as shown in FIG. 5, includes a first horizontal extension section 113 extending in a radial direction of the connector and a first vertical extension section 114 connected to the first horizontal extension section 113 and extending in an axial direction of the connector. The first mounting groove includes a first annular receiving portion 1312, as shown in FIGS. 3 and 4, adapted to receive the first cylindrical base portion 111 and a first recess 1311 adapted to receive the first horizontal extension section 113. A first elastic protrusion 131*a* is formed on an inner wall of the first recess 1311, and the first elastic protrusion 131*a* is adapted to lock the first horizontal extension section 113 in the first recess 1311.

As shown in FIGS. 3 and 4, the first insulative body 130 includes a first cylindrical extension 132 at a center of the first base 131, and a first central passageway 1321 is formed in the first cylindrical extension 132. The first inner terminal 120 is held in the first central passageway 1321.

As shown in FIG. 2, a ring-shaped projection 311 is formed on the inner wall of the first end of the outer contact 310 of the adapter 300 in a circumferential direction of the inner wall. In an embodiment, the ring-shaped projection 311 is formed to be an entire circumferential protrusion. In another embodiment, the ring-shaped projection 311 may include a plurality of small projections, which are separated from other and distributed in the circumferential direction of the inner wall of the first end of the outer contact 310 of the adapter 300. The distance between any two adjacent small projections is sized such that it is larger than a width of the contact point 112*c*. When the first outer terminal 110 is inserted into the first end of the outer contact 310, the pair of first elastic arms 112*a* and 112*b* are deformed inwardly so as to pass over the ring-shaped projection 311, and after passing the ring-shaped projection 311, the pair of first elastic arms 112*a* and 112*b* are deformed to their original shape. The contact points 112*c* of the first outer terminal 110 are blocked by the ring-shaped projection 311 so as to prevent the first outer terminal 110 inserted into the first end of the outer contact 310 from disengaging from the outer contact 310.

As shown in FIGS. 1-6, the second receptacle 200 includes a second outer terminal 210 in electrical contact with a second end of the outer contact 310, a second inner terminal 220 in electrical contact with a second end of the inner contact 320, and a second insulative body 230 between the second outer terminal 210 and the second inner terminal 220. The second insulative body 230 is configured to support both the second outer terminal 210 and the second inner terminal 220 and electrically isolate the second outer terminal 210 from the second inner terminal 220.

As shown in FIGS. 2, 3, and 5, the second outer terminal 210 includes a plurality of second elastic contact structures 212. Each of the second elastic contact structures 212 includes a second contact point 212*c* and a pair of second elastic arms 212*a*, 212*b* which intersect at the second contact point 212*c*. Each of the second elastic contact structures 212 is formed in a triangular shape. The second contact point 212*c* is adapted to elastically electrically contact with an inner wall of the second end of the outer contact 310.

The second inner terminal 220, as shown in FIG. 6, includes a cylindrical second plug end 221. The second end of the inner contact 320 is adapted to be plugged into the second plug end 221 of the second inner terminal 220, as shown in FIG. 2, such that it is in electrical contact with the second plug end 221 of the second inner terminal 220. At least one second axial slot 221*a* is formed on the second plug end 221 of the second inner terminal 220. The second plug end 221 of the second inner terminal 220 is an elastic claw having a multi-valve structure to elastically hold the second end of the inner contact 320 plugged therein.

The second outer terminal 210, as shown in FIGS. 3 and 5, includes a second cylindrical base portion 211. The plurality of second elastic contact structures 212 are connected to a first side of the second cylindrical base portion 211 and distributed at equal intervals in a circumferential direction of the second cylindrical base portion 211. The second outer terminal 210 includes a plurality of second soldering pins 213, 214 connected to a second side of the second cylindrical base portion 211 opposite the first side and distributed at equal intervals in the circumferential direction of the second cylindrical base portion 211.

The second insulative body 230, as shown in FIG. 4, includes a second base 231 on which a second mounting groove is formed. The second outer terminal 210 is adapted to be mounted and fixed in the second mounting groove. Each of the second soldering pins 213, 214, as shown in FIG. 5, includes a second horizontal extension section 213 extending in a radial direction of the connector and a second vertical extension section 214 connected to the second horizontal extension section 213 and extending in an axial direction of the connector. The second mounting groove, as shown in FIGS. 3 and 4, includes a second annular receiving portion 2312 adapted to receive the second cylindrical base portion 211 and a second recess 2311 adapted to receive the second horizontal extension section 213. A second elastic protrusion 213*a* is formed on an inner wall of the second recess 2311, and the second elastic protrusion 213*a* is adapted to lock the second horizontal extension section 213 in the second recess 2311.

As shown in FIGS. 3 and 4, the second insulative body 230 includes a second cylindrical extension 232 at a center of the second base 231 and a second central passageway 2321 is formed in the second cylindrical extension 232. The second inner terminal 220 is held in the second central passageway 2321.

As shown in FIG. 2, the inner wall of the second end of the outer contact 310 of the adapter 300 is formed to be a smooth inner wall without any projection. As a result, the second outer terminal 210 inserted into the second end of the outer contact 310 is adapted to be smoothly pulled out from the second end of the outer contact 310. A flared guide portion 312 that expands gradually in an outward direction is formed at the second end of the outer contact 310 so as to guide the second receptacle 200 to be properly inserted into the second end of the outer contact 310.

As shown in FIGS. 2 and 7-10, the insulator 330 of the adapter 300 is mounted in a passageway 3101 of the cylindrical outer contact 310 in an interference fit manner, and the cylindrical inner contact 320 is mounted in a center passageway 331 of the insulator 330 in an interference fit manner. A diameter of the cylindrical inner contact 320 is slightly smaller than a diameter of the center passageway 331 of the insulator 330, and a plurality of protuberances 321 are formed on an outer wall of the cylindrical inner contact 320 and thus in an interference fit with an inner wall of the central passageway 331 of the insulator 330.

In the foregoing embodiments, the triangular elastic contact structure 112, 212 adapted to elastically electrically contact with the inner wall of the outer contact 310 of the adapter 300 is formed on the outer terminal 110, 210 of the receptacle 100, 200. It is thereby easy to plug the outer terminal 110, 210 of the receptacle 100, 200 into the outer contact 310 of the adapter and the electrical contact reliability between the outer terminal 110, 210 and the outer contact 310 is improved, improving the performance of the RF connector. Further, the outer terminal 110, 210 of the receptacle 100, 200 is suitable for production by a stamping process, thereby reducing the production cost.

What is claimed is:

1. A connector, comprising:

an adapter including an outer contact, an inner contact, and an insulator between the outer contact and the inner contact, the outer contact and the inner contact each have a cylindrical shape; and a first receptacle adapted to be assembled onto a first end of the adapter, the first receptacle includes a first outer terminal in electrical contact with a first end of the outer contact, a first inner terminal in electrical contact with a first end of the inner contact, and a first insulative body between the first outer terminal and the first inner terminal, the first outer terminal includes a plurality of first elastic contact structures, each of the first elastic contact structures has an elastic arm and a first contact point formed on the elastic arm, the first contact point is adapted to elastically electrically contact an inner wall of the first end of the outer contact.

2. The connector of claim 1, wherein the elastic arm includes a pair of first elastic arms which intersect at the first contact point, each of the first elastic contact structures is formed in a triangular shape.

3. The connector of claim 1, wherein the first inner terminal has a cylindrical first plug end, the first end of the inner contact is adapted to be plugged into the first plug end of the first inner terminal to be in electrical contact with the first plug end of the first inner terminal.

4. The connector of claim 3, wherein the first plug end of the first inner terminal has a first axial slot, the first plug end of the first inner terminal is an elastic claw having a multi-valve structure to elastically hold the first end of the inner contact plugged therein.

5. The connector of claim 1, wherein a ring-shaped projection is formed on the inner wall of the first end of the outer contact of the adapter in a circumferential direction of the inner wall, the first contact points of the first outer terminal are blocked by the ring-shaped projection so as to prevent the first outer terminal inserted into the first end of the outer contact from disengaging from the outer contact.

6. The connector of claim 1, wherein the connector has a second receptacle adapted to be assembled onto a second end of the adapter, the second receptacle has a same structure as that of the first receptacle.

7. The connector of claim 6, wherein an inner wall of the second end of the outer contact of the adapter is a smooth inner wall without any projection, the second outer terminal inserted into the second end of the outer contact is adapted to be smoothly pulled out from the second end of the outer contact.

8. The connector of claim 6, wherein the second end of the outer contact has a flared guide portion that expands gradually in an outward direction to guide the second receptacle to be properly inserted into the second end of the outer contact.

9. The connector of claim 1, wherein the insulator of the adapter is mounted in a passageway of the cylindrical outer contact in an interference fit manner, the cylindrical inner contact is mounted in a center passageway of the insulator in an interference fit manner.

10. The connector of claim 9, wherein a diameter of the cylindrical inner contact is slightly smaller than a diameter of the center passageway of the insulator and a plurality of protuberances are formed on an outer wall of the cylindrical inner contact, the plurality of protuberances being in an interference fit with an inner wall of the central passageway of the insulator.

11. A receptacle adapted to be coupled to an end of an adapter, the receptacle comprising:

an outer terminal including plurality of elastic contact structures each having an elastic arm extending from a first end thereof, and at least one pin extending from a second end thereof opposite the first end;

an inner terminal disposed in the outer terminal; and an insulative body disposed between the outer terminal and the inner terminal, the insulative body supporting both the outer terminal and the inner terminal and electrically isolating the outer terminal from the inner terminal, the insulative body including a cylindrical base and a cylindrical extension extending from a center of the cylindrical base in a first axial direction, the at least one pin extending from the cylindrical base in a second axial direction opposite the first axial direction, and the plurality of elastic arms arranged about a circumference of the cylindrical extension and extending in the first axial direction, each of the elastic arms defining a contact point formed on a side of the elastic arm opposite the cylindrical extension, the contact point is adapted to elastically electrically contact with an inner facing wall of an outer contact of the adapter.

12. The receptacle of claim 11, wherein the inner terminal has a cylindrical plug end, an end of an inner contact of the adapter is adapted to be plugged into the cylindrical plug end of the inner terminal to be in electrical contact with the cylindrical plug end of the inner terminal.

13. The receptacle of claim 12, wherein an axial slot is formed on the plug end of the inner terminal, the plug end of the inner terminal is an elastic claw having a multi-valve structure to elastically hold the end of the inner contact plugged therein.

14. The connector of claim 1, wherein the first contact point is defined on a side of the elastic arm facing radially outward with respect to a center of the first outer terminal and contacts a radially inward facing side of the inner wall of the first end of the outer contact.

15. A connector, comprising:

an adapter including an outer contact, an inner contact, and an insulator between the outer contact and the inner contact, the outer contact and the inner contact each have a cylindrical shape; and a first receptacle adapted to be assembled onto a first end of the adapter, the first receptacle includes a first outer terminal in electrical contact with a first end of the outer contact, a first inner terminal in electrical contact with a first end of the inner contact, and a first insulative body between the first outer terminal and the first inner terminal, the first outer terminal includes a plurality of first elastic contact structures, each of the first elastic contact structures has an elastic arm and a first contact point formed on the elastic arm, the first contact point elastically electrically contacting an inner wall of the first end of the outer contact, wherein the first outer terminal includes a first cylindrical base portion and a plurality of first soldering pins, the plurality of first elastic contact structures are connected to a first side of the first cylindrical base portion and distributed at intervals in a circumferential direction of the first cylindrical base portion, the plurality of first soldering pins are connected to a second side of the first cylindrical base portion and distributed at intervals in the circumferential direction of the first cylindrical base portion.

16. The connector of claim 15, wherein the first insulative body has a first base on which a first mounting groove is formed, the first outer terminal is adapted to be mounted and fixed in the first mounting groove.

17. The connector of claim 16, wherein each of the first soldering pins has a first horizontal extension section extending in a radial direction of the connector and a first vertical extension section connected to the first horizontal extension section and extending in an axial direction of the connector.

18. The connector of claim 17, wherein the first mounting groove has a first annular receiving portion adapted to receive the first cylindrical base portion and a first recess adapted to receive the first horizontal extension section, a first elastic protrusion is formed on an inner wall of the first recess and adapted to lock the first horizontal extension section in the first recess.

19. The connector of claim 16, wherein the first insulative body has a first cylindrical extension at a center of the first base, a first central passageway is formed in the first cylindrical extension and the first inner terminal is held in the first central passageway.

20. The receptacle of claim 11, further comprising a pair of elastic arms that intersect at the contact point, each of the elastic contact structures is formed in a triangular shape.

* * * * *